United States Patent [19]

Grahl

[11] 4,026,320

[45] May 31, 1977

[54] VALVE ASSEMBLY FOR PANEL MOUNTING

[75] Inventor: Darwin R. Grahl, Newark, N.Y.

[73] Assignee: Parker-Hannifin Corporation, Cleveland, Ohio

[22] Filed: Aug. 7, 1975

[21] Appl. No.: 602,798

[52] U.S. Cl. ..... 137/343; 62/292; 137/356

[51] Int. Cl.² ..... F25B 49/00; F25B 45/00

[58] Field of Search ..... 137/343, 356–362; 62/77, 292

[56] References Cited

UNITED STATES PATENTS

| | | | |
|---|---|---|---|
| 3,025,085 | 3/1962 | Young | 137/360 X |
| 3,302,421 | 2/1967 | Karnes | 62/77 |
| 3,785,163 | 1/1974 | Wagner | 62/77 |
| 3,916,947 | 11/1975 | Holmes et al. | 137/360 X |

*Primary Examiner*—Alan Cohan
*Assistant Examiner*—Gerald A. Michalsky
*Attorney, Agent, or Firm*—John N. Wolfram

[57] ABSTRACT

A valve assembly particularly adapted for air conditioning systems and with provision for mounting on a panel or housing wall. The valve assembly has an elongated body with three bosses extending radially therefrom. The body has abutment faces at two of the bosses and has an abutment shoulder at the third boss, which is between the other two bosses. The abutment faces lie in a common plane and are adapted to contact one side of a panel or housing wall that has openings through which the three bosses may project. A jam nut is threaded onto the middle boss for contacting the other side of the panel or housing wall for clamping the same against the abutment faces. The abutment shoulder is inwardly offset a slight distance from the abutment faces to assure that the panel or housing wall will contact the abutment faces when the jam nut is tightened but it will serve as a stop to prevent undue bending of the panel or housing wall under pressure of the jam nut.

3 Claims, 2 Drawing Figures

VALVE ASSEMBLY FOR PANEL MOUNTING

BACKGROUND OF THE INVENTION

It is a common practice in air conditioning systems to use a combination shut-off valve and charging valve in the suction line leading to the compressor. It has heretofore been proposed to provide such combination valve in the form of an elongated body with three bosses projecting therefrom in the same direction so that the valve body could be mounted on the inside of the compressor housing but with the three bosses extending through the housing wall for access from the outside of the compressor housing. One of such bosses contains the shut-off valve, another the charging valve, and the third provides a fitting for connecting the valve body to the portion of the suction line connected to the system evaporator. Another boss is provided on the body for connection to the portion of the suction line connected to the compressor but this boss does not project through the compressor housing.

Such prior known combination valve for mounting within a compressor housing has heretofore been attached to the housing wall by a separate U-shaped bracket and mounting screws. This requires an extra part and several screws.

SUMMARY OF THE INVENTION

The present invention provides a mounting arrangement for a combination valve of the type described in which the only extra part for accomplishing such mounting is a jam nut. One of the three bosses is externally threaded to receive the jam nut. The body has formed thereon several abutment surfaces for engaging the inside wall of the compressor housing. The jam nut bears against the outer side of the compressor housing to clamp the valve body to the housing wall with the abutment surfaces in engagement therewith.

One of the abutment surfaces is adjacent the boss carrying the jam nut and is slightly offset in a direction toward the valve body from a common plane containing the other abutment surfaces to assure that such other abutment surfaces will contact the housing wall and wherein deflection of the housing wall by the jam nut after such contact will be limited.

DETAIL DESCRIPTION

Figure 1:
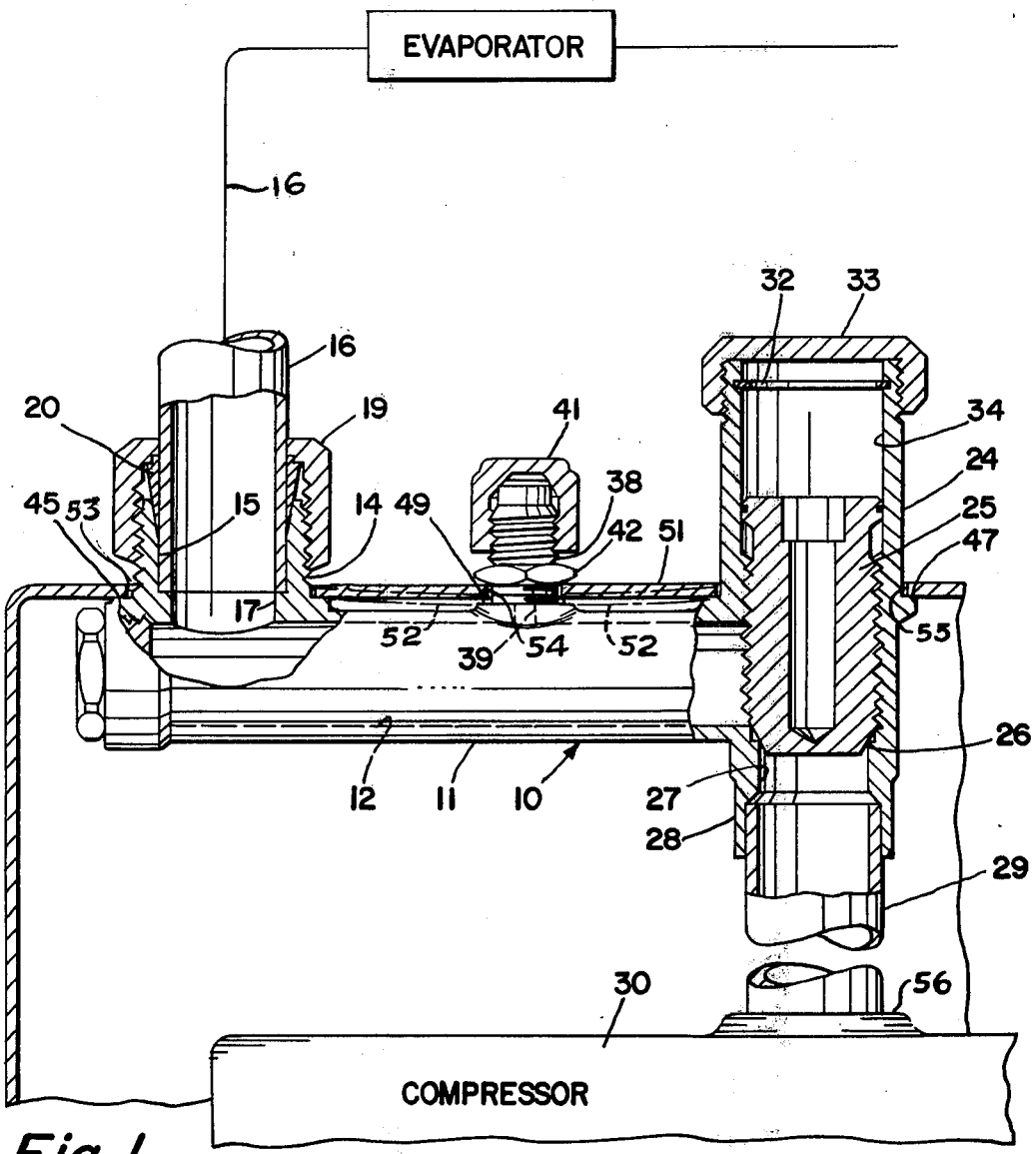
FIG. 1 is a view partly in cross section of the combination valve as mounted on a compressor housing.

The combination valve 10 includes an elongated body 11 having a longitudinally extending bore 12 therein. At one of its ends, body 11 has projecting therefrom in a radial direction relative to the longitudinal axis of body 11 a first boss 14. This boss has machined therein a counterbore 15 for receiving tube 16 for communication with a transverse bore 17 that communicates with one end of bore 12. The exterior of boss 14 is threaded for receiving a nut 19 that clamps a sleeve 20 into gripping and sealing contact with tube 16.

At its other end, body 11 has a second boss 24 projecting therefrom in the same radial direction as boss 14. Threadably mounted within this boss is a shunt-off valve element 25 that may be threaded into and out of engagement with a valve seat 26 that surrounds a transverse port 27 in a boss 28 that is adapted to receive a tube 29 leading to compressor 30. A snap ring 32 prevents accidental unthreading of valve element 25 to the point where it may be disconnected from the body threads engaged therewith and a cap 33 is threaded to boss 24 for closing bore 34 in the latter but which may be removed to permit access to valve element 25 for adjusting the position of the latter.

Figure 2:
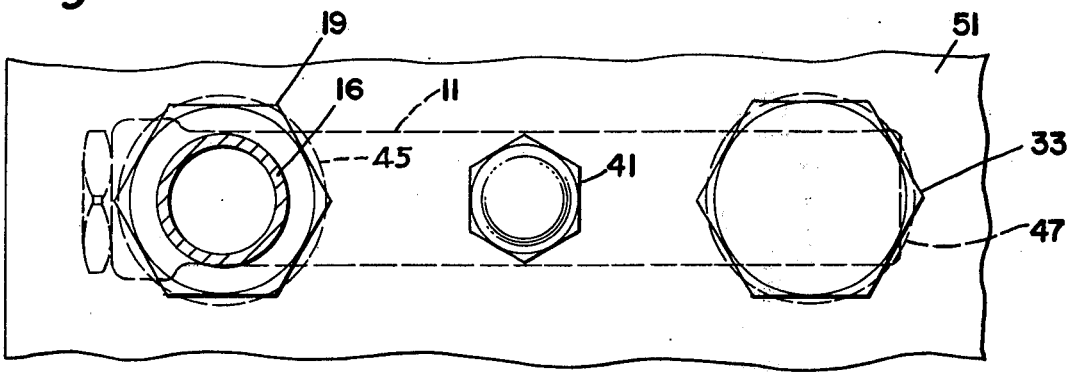
FIG. 2 is a top view of the valve so mounted.

Body 11 has a third boss 38 projecting therefrom approximately midway between bosses 14 and 24 and in the same radial direction. Also, as shown in FIG. 2, the centerlines or longitudinal axis of bosses 14, 38 and 24 are in a common plane that intersects the centerline or longitudinal axis of bore 12.

The interior of third boss 38 contains a valve element that is the same as a conventional valve for automobile tires. Such valve opens to permit introduction of refrigerant fluid through charging port 39 and into body 11 when charging or filling the air conditioning system with the refrigerant fluid. When charging has been completed, the valve within boss 38 closes to prevent loss of refrigerant fluid. Loss of such fluid is also prevented by a cap 41 threaded to the exterior of boss 38 after charging has been completed. Also threaded onto boss 38 is a jam nut 42.

Body 11 has formed thereon a first abutment face 45 at the base of boss 14 and which is of larger diameter than such boss. Likewise, body 11 has a second abutment face 47 at the base of and of larger diameter than second boss 24.

Body 11 has another abutment surface or shoulder 49 at the base of and of larger diameter than third boss 38. Abutment faces 45 and 47 lie in a common plane that is perpendicular to the direction of the axes of bosses 14, 24 and 38. Abutment surface 49 is parallel to such common plane but is spaced inwardly toward body 11 a distance of about 0.010 inches from such common plane.

When installing the combination valve 10 within the compressor housing 51, nuts 19, 41, 42 and 33 are removed from body 11 and the latter is inserted into the housing with bosses 14, 38 and 24 projecting through respective openings 53, 54 and 55 previously formed in the housing wall. Jam nut 42 is then threaded onto boss 38 and tightened against the outer face of housing wall 51. This draws the valve body toward the housing wall until the latter is engaged by abutment faces 45 and 47. At this time abutment surface 49 will be spaced about 0.010 inches from wall 51. Further tightening of the jam nut will then deflect the housing wall, as indicated by the dotted lines 52, until the wall engages abutment surface 49. Such engagement prevents further deflection of the housing wall, which would be unsightly and perhaps cause damage thereto. Also, the slight deflection creates a spring type load on jam nut 42 in the manner of a lock washer to prevent accidental loosening of the jam nut. Tube 29 may then be sweated to boss 28 and to inlet 56 of compressor 30. The valve assembly is then ready for connection to line 16 by way of sleeve 20 and nut 49 and is also ready for filling of the system with refrigerant fluid by way of conventional methods.

I claim:

1. A valve assembly for mounting on a panel of flat bendable material, said assembly comprising an elongated body having a longitudinal bore and a longitudinal axis, said body including a first boss projecting from one end of the body, a second boss projecting from the other end of the body, and a third boss projecting from the body between the first and second bosses, each boss projecting radially with respect to said axis and in the same direction, a port in said body in axial alignment with said first boss and intersecting said bore, a valve element mounted in said first boss for movement to open and close said port, fluid flow passages in said second and third bosses communicating with said bore, said body having a raised abutment face at the inner end of each of said first and second bosses, said faces lying in a common plane spaced a predetermined distance from said longitudinal axis, said third boss having a threaded exterior, a jam nut threaded onto said threaded exterior, a raised abutment surface at the inner end of the third boss lying in a second plane that is parallel to said common plane and radially spaced from said axis a distance that is less than said predetermined distance whereby when said body is placed on one side of said flat panel with said bosses projecting through holes in said panel that are in alignment with said bosses and with said abutment faces engaging said one side of the panel, said jam nut may be threaded against the other side of said panel for first tightly clamping the panel against said abutment faces while said panel remains spaced from said abutment surface and whereby upon further threading of the jam nut the nut will cause the panel to bend slightly and be more tightly clamped against said abutment faces, and said abutment surface being sufficiently close to said plane whereby upon such slight bending the panel will engage said abutment surface to limit the amount of such bending.

2. The assembly of claim 1 in which said abutment surface is offset from said common plane about 0.010 inch.

3. In combination a valve assembly and a panel of thin bendable material upon which the valve assembly may be mounted, said valve assembly comprising an elongated body having a longitudinal bore and a longitudinal axis, said body including a first boss projecting from one end of the body, a second boss projecting from the other end of the body, and a third boss projecting from the body between the first and second bosses, each boss having a longitudinal axis that is perpendicular to a plane through said longitudinal axis and all three bosses being on one side of said plane, a first port in said second boss connected with said one end of the bore, a second port in said body communicating with said other end of the bore, a valve element mounted in said first boss and movable into position for opening and closing said communication, said body having a raised abutment face at the inner end of each of said first and second bosses that is perpendicular to the longitudinal axis of the respective one of said first and second bosses, said abutment faces lying in a common plane, said third boss having a threaded cylindrical exterior, a jam nut threaded onto said cylindrical exterior, said body having a raised annular abutment surface at the inner end of said third boss that is of greater diameter than said threaded cylindrical exterior and which lies in a plane parallel to said common plane, said abutment surface being radially spaced from said longitudinal axis a distance that is less than the distance of said common plane from said longitudinal axis, said jam nut being threadable on said third boss against said panel for first causing the panel to tightly engage said abutment faces and then causing the panel to bend and engage said abutment surface to limit further bending of the panel, and said bending of the panel imposing a spring type load on the jam nut to resist loosening of the jam nut on the threaded third boss.

* * * * *